US009163460B2

(12) United States Patent
Isenhour et al.

(10) Patent No.: US 9,163,460 B2
(45) Date of Patent: Oct. 20, 2015

(54) WELLBORE CONDITIONING SYSTEM

(71) Applicants: James D. Isenhour, Windsor, CO (US); Gilbert T. Meier, Vernal, UT (US)

(72) Inventors: James D. Isenhour, Windsor, CO (US); Gilbert T. Meier, Vernal, UT (US)

(73) Assignee: Extreme Technologies, LLC, Vernal, UT (US)

( * ) Notice: Subject to any disclaimer, the term of this patent is extended or adjusted under 35 U.S.C. 154(b) by 442 days.

(21) Appl. No.: 13/644,218

(22) Filed: Oct. 3, 2012

(65) Prior Publication Data

US 2013/0180779 A1 Jul. 18, 2013

Related U.S. Application Data

(60) Provisional application No. 61/542,601, filed on Oct. 3, 2011, provisional application No. 61/566,079, filed on Dec. 2, 2011.

(51) Int. Cl.
*E21B 10/26* (2006.01)
*E21B 44/00* (2006.01)

(52) U.S. Cl.
CPC ..... *E21B 10/26* (2013.01); *E21B 44/00* (2013.01)

(58) Field of Classification Search
CPC ..... E21B 7/28; E21B 10/26; E21B 10/28; E21B 10/30
See application file for complete search history.

(56) References Cited

U.S. PATENT DOCUMENTS

| | | | | |
|---|---|---|---|---|
| 1,489,849 | A * | 4/1924 | Riddle | 175/391 |
| 3,237,705 | A * | 3/1966 | Williams, Jr. | 175/406 |
| 5,372,351 | A | 12/1994 | Oliver | |
| 5,765,653 | A * | 6/1998 | Doster et al. | 175/75 |
| 6,257,279 | B1 | 7/2001 | Peltz | |
| 6,386,302 | B1 * | 5/2002 | Beaton | 175/406 |
| 6,607,371 | B1 | 8/2003 | Raymond et al. | |
| 6,695,080 | B2 * | 2/2004 | Presley et al. | 175/391 |
| 6,920,944 | B2 | 7/2005 | Eppink et al. | |
| 6,973,974 | B2 | 12/2005 | McLoughlin et al. | |
| 6,991,046 | B2 | 1/2006 | Fielder et al. | |
| 8,752,649 | B2 | 6/2014 | Isenhour | |
| 8,813,877 | B1 | 8/2014 | Short | |
| 8,851,205 | B1 | 10/2014 | Short | |
| 2010/0116556 | A1 | 5/2010 | Buske | |
| 2011/0127044 | A1 * | 6/2011 | Radford et al. | 166/373 |
| 2014/0064646 | A1 | 3/2014 | Meier | |
| 2014/0131111 | A1 * | 5/2014 | Desmette et al. | 175/57 |

FOREIGN PATENT DOCUMENTS

WO WO 2008/026011 3/2008

OTHER PUBLICATIONS

PCT Patentability Report for PCT/US13/050205, dated Dec. 23, 2013.
PCT Search Report for PCT/US2012/032714, dated Jun. 20, 2012.
U.S. Appl. No. 14/018,066, Meier, et al.
(Continued)

*Primary Examiner* — Robert E Fuller
*Assistant Examiner* — Steven MacDonald
(74) *Attorney, Agent, or Firm* — Remenick, PLLC

(57) ABSTRACT

A wellbore conditioning system is disclosed. The system comprises at least one shaft and at least two eccentric unilateral reamers, wherein the unilateral reamers are positioned at a predetermined distance from each other and the unilateral reamers are positioned at a predetermined rotational angle from each other.

16 Claims, 5 Drawing Sheets

(56) References Cited

OTHER PUBLICATIONS

PCT Search Report and Patentability Report for PCT/US2012/58573, dated Jan. 22, 2013.
U.S. Appl. No. 13/442,316, Michener.
U.S. Appl. No. 13/441,230, Michener.
U.S. Appl. No. 13/517,870, Michener.
U.S. Appl. No. 14/018,066, Meier.
European Search Report for EU 12837996.3, dated Aug. 18, 2015.

* cited by examiner

WELLBORE CONDITIONING SYSTEM

REFERENCE TO RELATED APPLICATIONS

This application claims priority to provisional applications U.S. Provisional Application Ser. No. 61/542,601, filed Oct. 3, 2011, and U.S. Provisional Application Ser. No. 61/566,079, filed Dec. 2, 2011, both entitled "Wellbore Conditioning System," both of which are specifically and entirely incorporated by reference.

BACKGROUND

1. Field of the Invention

The invention is directed to wellbore conditioning systems and devices. In particular, the invention is directed to systems and devices for conditioning horizontal wellbores.

2. Background of the Invention

Drill bits for drilling oil, gas, and geothermal wells, and other similar uses typically comprise a solid metal or composite matrix-type metal body having a lower cutting face region and an upper shank region for connection to the bottom hole assembly of a drill string formed of conventional jointed tubular members which are then rotated as a single unit by a rotary table or top drive drilling rig, or by a downhole motor selectively in combination with the surface equipment. Alternatively, rotary drill bits may be attached to a bottom hole assembly, including a downhole motor assembly, which is, in turn, connected to a drill string wherein the downhole motor assembly rotates the drill bit. The bit body may have one or more internal passages for introducing drilling fluid, or mud, to the cutting face of the drill bit to cool cutters provided thereon and to facilitate formation chip and formation fines removal. The sides of the drill bit typically may include a plurality of radially or laterally extending blades that have an outermost surface of a substantially constant diameter and generally parallel to the central longitudinal axis of the drill bit, commonly known as gage pads. The gage pads generally contact the wall of the borehole being drilled in order to support and provide guidance to the drill bit as it advances along a desired cutting path or trajectory.

During the drilling of horizontal oil and gas wells, for example, the trajectory of the wellbore is often uneven and erratic. The high tortuosity of a wellbore, brought about from geo-steering, directional drilling over corrections, and/or formation interaction, makes running multi stage expandable packer assembles or casing in such wells extremely difficult and sometimes impossible. While drilling long reach horizontal wells, the friction generated from the drill string and wellbore interaction severely limits the weight transfer to the drill bit, thus lowering the rate of penetration and potentially causing numerous other issues and, in a worst case scenario, the inability to reach the total planned depth of the well.

Currently the majority of hole enlargement tools have either a straight mechanical engagement or hydraulic engagement. These tools have had several reliability issues, including: premature engagement, not opening to their desired position, and not closing fully, all of which can lead to disastrous results. Such tools include expandable bits, expandable hole openers, and expandable stabilizers. The use of conventional fixed concentric stabilizers and reaming-while-drilling tools have also proven to be ineffective in most cases.

SUMMARY OF THE INVENTION

The present invention overcomes the problems and disadvantages associated with current strategies and designs and provides new tools and methods of conditioning wellbores.

An embodiment of the invention is directed to a wellbore conditioning system. The system comprises at least one shaft and at least two unilateral reamers extending from the at least one shaft. The unilateral reamers are positioned at a predetermined distance from each other and the unilateral reamers are positioned at a predetermined rotational angle from each other.

Preferably, each unilateral reamer extends from an outer surface of the at least one shaft in a direction perpendicular to the axis of rotation of the shaft. In the preferred embodiment, each reamer is comprised of a plurality of blades, wherein each blade has a larger radius than a previous blade in the direction of counter rotation. The system preferably further comprises a plurality of cutters coupled to each blade. Each cutter is preferably a Polycrystalline Diamond Compact (PDC) cutter. The system also preferably further comprises at least one dome slider coupled to each blade. Preferably, each dome slider is a PDC dome slider.

Preferably, there is a recess in the at least one shaft adjacent to each reamer. In the preferred embodiment, the at least one shaft and reamers are made from a single piece of material. Preferably there are a plurality of shafts and each shaft comprises one reamer.

Another embodiment of the invention is directed to a wellbore drilling string. The wellbore drilling string comprises a drill bit, a downhole mud motor, a measurement-while-drilling (MWD) device relaying the orientation of the drill bit and the downhole mud motor to a controller, and a wellbore conditioning system. The wellbore conditioning system comprises at least one shaft and at least two eccentric unilateral reamer extending from the shaft. The unilateral reamers are positioned at a predetermined distance from each other and the unilateral reamers are positioned at a predetermined rotational angle from each other. The wellbore conditioning system is positionable within the wellbore drill string at a location in or around the bottom hole assembly.

Preferably, each unilateral reamer extends from an outer surface of the at least one shaft in a direction perpendicular to the axis of rotation of the at least one shaft. In the preferred embodiment, each reamer is comprised of a plurality of blades, wherein each blade has a larger radius than a previous blade in the direction of counter rotation. The wellbore conditioning system preferably further comprises a plurality of cutters coupled to each blade. Each cutter is preferably a Polycrystalline Diamond Compact (PDC) cutter. The wellbore conditioning system preferably also further comprises at least one dome slider coupled to each blade. Preferably, each dome slider is a PDC dome slider.

Preferably, there is a recess in the at least one shaft adjacent to each reamer. In the preferred embodiment, the at least one shaft and reamers are made from a single piece of material. Preferably, there is a plurality of shafts and each shaft comprises one reamer.

Other embodiments and advantages of the invention are set forth in part in the description, which follows, and in part, may be obvious from this description, or may be learned from the practice of the invention.

DESCRIPTION OF THE DRAWING

The invention is described in greater detail by way of example only and with reference to the attached drawing, in which.

DESCRIPTION OF THE INVENTION

As embodied and broadly described herein, the disclosures herein provide detailed embodiments of the invention. However, the disclosed embodiments are merely exemplary of the invention that may be embodied in various and alternative forms. Therefore, there is no intent that specific structural and functional details should be limiting, but rather the intention is that they provide a basis for the claims and as a representative basis for teaching one skilled in the art to variously employ the present invention A problem in the art capable of being solved by the embodiments of the present invention is conditioning narrow wellbores without interfering with the drilling devices. It has been surprisingly discovered that positioning a pair of unilateral reamers along a shaft allows for superior conditioning of narrow wellbores compared to existing technology.

Figure 1:
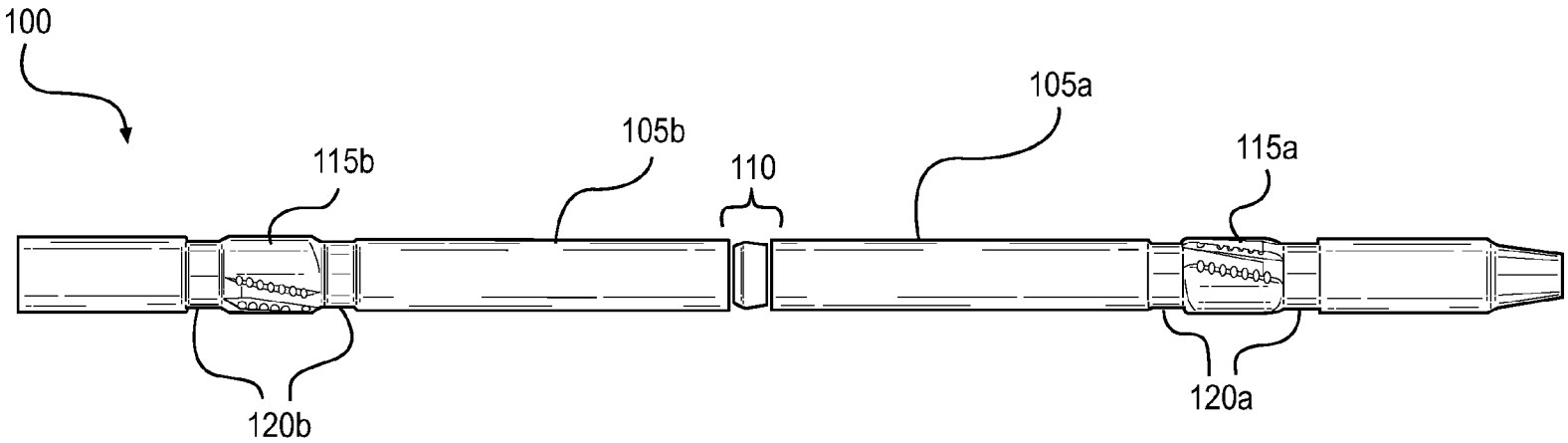
FIG. 1 is a schematic of an embodiment of the system of the invention.

FIG. 1 depicts a preferred embodiment of the wellbore conditioning system 100. In the preferred embodiment, wellbore condition system 100 is comprised of a single shaft. However, in other embodiments, wellbore conditioning system 100 is comprised of leading shaft 105*a* and trailing shaft 105*b*, as shown in FIG. 1. While two shafts are shown, another number of shafts can be used, for example, three or four shafts can be used. Preferably the total shaft length is ten feet, however the shaft can have other lengths. For example, the total shaft length shaft can be eight feet or twelve feet in length. In embodiments with two shafts, shafts 105*a* and 105*b* are coupled at joint 110 (in FIG. 1, joint 110 is shown prior to coupling shafts 105*a* and 105*b*). In the preferred embodiment, joint 110 is a screw joint, wherein the male portion of joint 110 attached to shaft 105*b* has exterior threads and the female portion of joint 110 attached to shaft 105*a* has interior threads. However, another type of coupling can be used, for example the portions of joint 110 depicted in FIG. 1 can be reversed with the male portion on shaft 105*a* and the female portion on shaft 105*b*. Furthermore, other methods of joining shaft 105*a* to shaft 105*b* can be implemented, such as welding, bolts, friction joints, and adhesive. In the preferred embodiment, upon being joined, shafts 105*a* and 105*b* are coaxial and rotate in unison. Furthermore, in the preferred embodiment, joint 110 may be more resistant to bending, breaking, or other failure than if shafts 105*a* and 105*b* were a uni-body shaft.

In the preferred embodiment the shaft is comprised of steel, preferably 4145 or 4140 steel alloys. However, the shaft can be made of other steel alloys, aluminum, carbon fiber, fiberglass, iron, titanium, tungsten, nylon, other high strength materials, or combinations thereof. Preferably, the shaft is milled out of a single piece of material, however other methods of creating the shaft can be used. For example, the shaft can be cast, rotomolded, made of multiple pieces, injection molded, and combinations thereof. The preferred outer diameter of the shaft is approximately 5.5 inches, however the shaft can have other outer diameters (e.g. 10 inches, 20 inches, 30 inches, or another diameter common to wellbores). As discussed herein, the reamers extend beyond the outer diameter of the shaft.

As shown in FIG. 1, in the two shaft embodiment, each of shafts 105*a* and 105*b* has a single unilateral reamer 115*a* and 115*b*, respectively. In the uni-body shaft embodiment, the shaft has at least two unilateral reamers 115*a* and 115*b*. Each reamer 115*a* and 115*b* projects from the body of the shaft on one, single side of the shaft. Furthermore, each reamer 115*a* and 115*b* is preferably situated eccentrically on the body of shafts 105*a* and 115*b* such that the centers of mass of the reamers 115*a* and 115*b* are not coaxial with the centers of mass of the body of shafts 105*a* and 115*b*. As can be seen in FIG. 1, reamer 115*a* projects in a first direction (upwards on FIG. 1), while reamer 115*b* projects in a second direction (downwards on FIG. 1). While reamers 115*a* and 115*b* are shown 180° apart from each other, there can be other rotational configurations. For example, reamers 115*a* and 115*b* can be 90°, 45°, or 75° apart from each other. In the preferred embodiment, reamers 115*a* and 115*b* are identical, however deviations in reamer configuration can be made depending on the intended use of the system 100.

Figure 5:
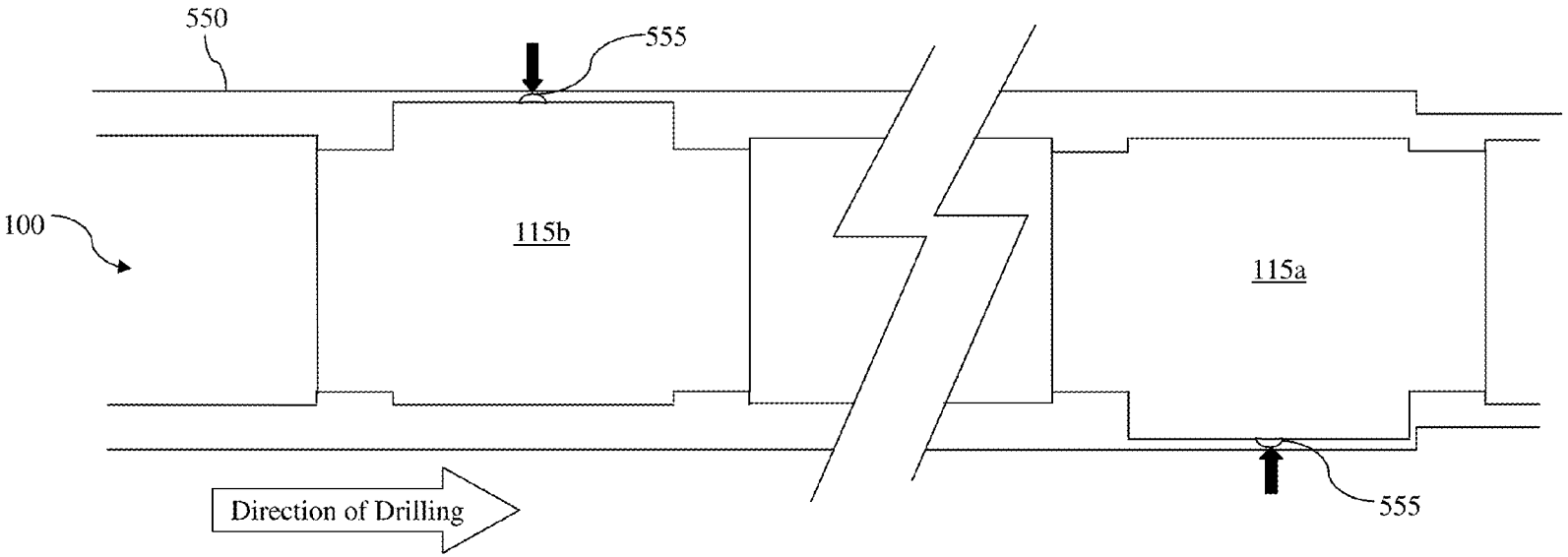
FIG. 5 is an exaggerated view of an embodiment of the system within a wellbore.

As shown in the embodiment of the system 100 depicted in FIG. 5, in operation, the first reamer 115*a* bores into one portion of the wellbore 550 while the second reamer 115*b* bores into a diametrically opposed portion of the wellbore 550. The opposing forces (shown by the arrows in FIG. 5) created by the diametrically opposed reamers centralize the system 100 within the wellbore 550. This self-centralizing feature allows system 100 to maintain a central location within wellbore 500 while having no moving parts.

In the preferred embodiment each of reamers 115*a* and 115*b* has four blades, however, there can be another number of blades (e.g., one blade, three blades, or five blades). Preferably, the radius of each of the four blades projects from shafts 105*a* and 105*b* at a different increment. The incremental increase in the radius of the blades allows the first blade in the direction of counter rotation (i.e., the first blade to contact the surface of the wellbore) to remove a first portion of the wellbore wall, the second blade in the direction of counter rotation to remove a second, greater portion of the wellbore wall, the third blade in the direction of counter rotation to remove a third, greater portion of the wellbore wall, and the fourth blade in the direction of counter rotation to remove a fourth, greater portion of the wellbore wall, so that, after the fourth blade, the wellbore is the desired size. The progressing counter rotation blade radius layout creates an equalizing depth of cut. Cutter work load is evenly distributed from blade to blade as the wellbore is being enlarged and conditioned. This calculated cutter work rate reduces impact loading. The reduction of impact loading translates into reduced torque and cutter fatigue. Furthermore, due to the gradual increase of the radius of the blades, there is a smooth transition to full bore diameter, which preferably reduces vibration and torque on system 100.

Figure 2:
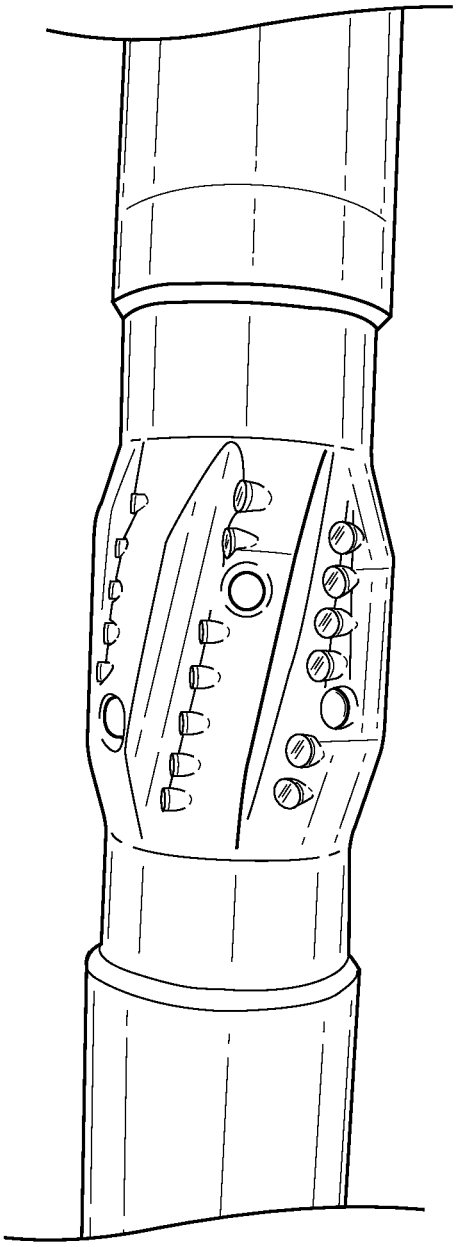
FIGS. 2-4 are views of an embodiment of the reamers of the invention.
Figure 3:
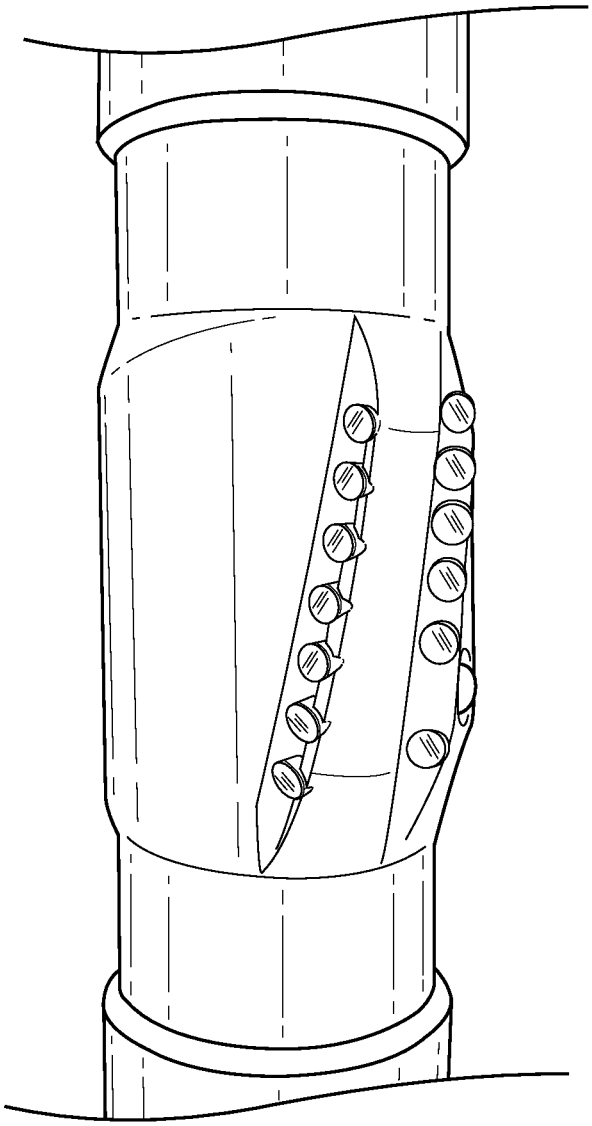
Figure 4:
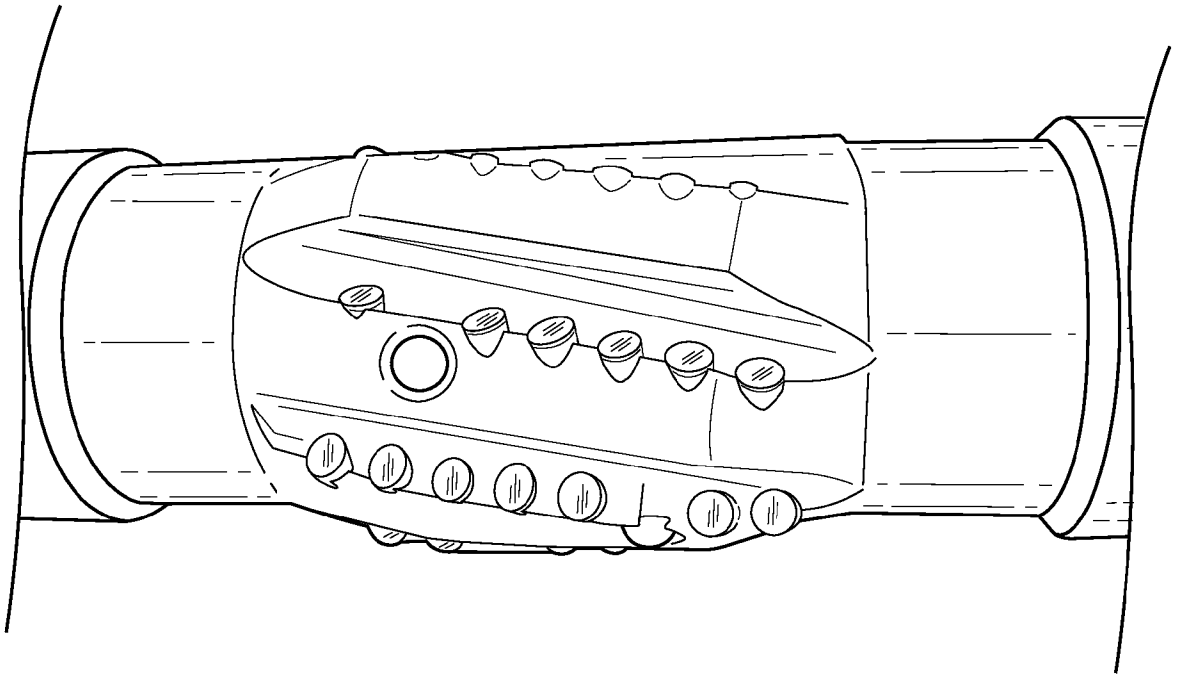

As can be seen in FIGS. 2-4, each of the blades has a plurality of cutters. Preferably, the cutters are Polycrystalline Diamond Compact (PDC) cutters. However, other materials, such as aluminum oxide, silicon carbide, or cubic boron nitride can be used. Each of the cutters is preferably 7/11 of an inch (16 mm) in diameter, however the cutters can have other diameters (i.e., ½ an inch, ¾ of an inch, or ⅝ of an inch). The cutters are preferably replaceable and rotatable. In certain embodiments, the cutters have a beveled outer edge to prevent chipping and reduce the torque generated from the cutting structure. In a preferred embodiment, the blades have at least one dome slider 555, as shown in FIG. 5. Preferably, the dome slider 555 is made of the same material as the cutters. The dome slider 555 is preferably a rounded or semi rounded surface that reduces friction with the wellbore wall while the system slides though the wellbore, thus protecting the cutters from damage. The dome sliders 555 contact the surface of the wellbore 550 wall or casing and create a standoff of the reamer blade which aids in the ability of the system 100 to slide through the wellbore 550 when the drill string is not in rotation. Additionally, during operation of system 100, dome sliders 555 allow the system to rotate within wellbore 550 with less friction than without the dome sliders, thereby decreasing the torque needed to rotate the system and reducing the damage to the casing and the cutting structure of the tool during the tripping operation. Furthermore, as the system 100 slides through or rotates within a casing, the dome sliders 555 protect the casings from the cutters.

Returning to FIG. 1, disposed on either side of each of reamers 115*a* and 115*b* are preferably recesses 120*a* and 120*b*. Recesses 120*a* and 120*b* have a smaller diameter than the body of shafts 105*a* and 105*b*. Preferably, recesses 120*a* and 120*b* facilitate debris removal while system 100 is conditioning. Furthermore, recesses 120*a* and 120*b* may increase the ease of milling reamers 115*a* and 115*b*.

Reamers 115*a* and 115*b* are preferably disposed along the shaft at a predetermined distance apart. For example, the reamers can be 4 feet, 5 feet, 6 feet, or another distance apart. The distance between reamers 115*a* and 115*b* as well as the rotational angle of reamers 115*a* and 115*b* can be optimized based on the characteristics (e.g., the desired diameter and curvature) of the wellbore. The further apart, both in distance and rotation angle, the two reamers are positioned, the narrower the wellbore system 100 can drift through. The outer reamer body diameter plays a critical part in the performance of system 100. Furthermore, having adjustable positioning of the reamers 115*a* and 115*b* allows system 100 to achieve multiple pass-thru/drift requirements using the single tool.

Preferably, system 100 is positioned at a predetermined location up-hole from the directional bottom-hole assembly. The directional bottom-hole assembly may included, for example, the drill bit, bit sub, downhole mud motor (e.g. a bent housing motor), and a measurement-while-drilling device, drill collars, a directional control device, and other drilling devices. By placing the wellbore conditioning system in or around the bottom hole assembly of the drill string, the reaming tool will have little to no adverse affect on the ability to steer the directional assembly or on the rate of penetration, and can achieve the desired build or drop rates.

Other embodiments and uses of the invention will be apparent to those skilled in the art from consideration of the specification and practice of the invention disclosed herein. All references cited herein, including all publications, U.S. and foreign patents and patent applications, are specifically and entirely incorporated by reference. It is intended that the specification and examples be considered exemplary only with the true scope and spirit of the invention indicated by the following claims. Furthermore, the term "comprising of" includes the terms "consisting of" and "consisting essentially of."

The invention claimed is:

1. A wellbore conditioning system, comprising:
two coaxial shafts;
a screw joint coupling the two coaxial shafts; and
one unilateral reamer having only four cutting blades extending from each coaxial shaft, wherein the unilateral reamers are positioned at a predetermined distance from each other and, counter to the direction of rotation, the first blade extends a first distance from the drill string, the second blade extends a second distance from the drill string greater than the first distance, the third blade extends a third distance from the drill string greater than the second distance, and the fourth blade extends a fourth distance from the drill string greater than the third distance;
wherein the unilateral reamers are diametrically opposed to each other and do not overlap.

2. The wellbore conditioning system of claim 1, wherein each unilateral reamer extends from an outer surface of the at least one shaft in a direction perpendicular to the axis of rotation of the two coaxial shafts.

3. The wellbore conditioning system of claim 1, further comprising a plurality of cutters coupled to each blade.

4. The wellbore conditioning system of claim 3, wherein each cutter is a Polycrystalline Diamond Compact (PDC) cutter.

5. The wellbore conditioning system of claim 1, further comprising at least one dome slider coupled to each blade.

6. The wellbore conditioning system of claim 5, wherein each dome slider is a PDC dome slider.

7. The wellbore conditioning system of claim 1, further comprising a recess in each shaft adjacent to each reamer.

8. A wellbore drilling string, comprising:
a drill bit;
a downhole mud motor;
a measurement-while-drilling (MWD) device relaying the position of the drill bit and the downhole mud motor to a controller; and
a wellbore conditioning system, wherein the wellbore conditioning system comprises:
two coaxial shafts;
a screw joint coupling the two coaxial shafts; and
one unilateral reamer having only four cutting blades extending from each coaxial shaft, wherein the unilateral reamers are positioned at a predetermined distance from each other and counter to the direction of rotation, the first blade extends a first distance from the drill string, the second blade extends a second distance from the drill string greater than the first distance, the third blade extends a third distance from the drill string greater than the second distance, and the fourth blade extends a fourth distance from the drill string greater than the third distance;
wherein the unilateral reamers are diametrically opposed to each other and do not overlap; and
wherein the wellbore conditioning system is positionable within the wellbore drill string at a location in or around the bottom hole assembly.

9. The wellbore drilling string of claim 8, wherein each unilateral reamer extends from an outer surface of the at least one shaft in a direction perpendicular to the axis of rotation of the two coaxial shafts.

10. The wellbore drilling string of claim 8, further comprising a plurality of cutters coupled to each blade.

11. The wellbore drilling string of claim 10, wherein each cutter is a Polycrystalline Diamond Compact (PDC) cutter.

12. The wellbore drilling string of claim 8, further comprising at least one dome slider coupled to each blade.

13. The wellbore drilling string of claim 12, wherein each dome slider is a PDC dome slider.

14. The wellbore drilling string of claim 8, further comprising a recess in each shaft adjacent to each reamer.

15. A wellbore conditioning system, comprising:
two coaxial shafts;
a screw joint coupling the two coaxial shafts; and
one unilateral reamer having four cutting blades extending from each coaxial shaft, wherein the unilateral reamers are positioned at a predetermined distance from each other and, counter to the direction of rotation, the first blade extends a first distance from the drill string, the second blade extends a second distance from the drill string greater than the first distance, the third blade extends a third distance from the drill string greater than the second distance, and the fourth blade extends a fourth distance from the drill string greater than the third distance, wherein none of the blades extends the same distance as any other blade;

wherein the unilateral reamers are diametrically opposed to each other and do not overlap.

16. A wellbore drilling string, comprising:

a drill bit;

a downhole mud motor;

a measurement-while-drilling (MWD) device relaying the position of the drill bit and the downhole mud motor to a controller; and a wellbore conditioning system, wherein the wellbore conditioning system comprises:

two coaxial shafts;

a screw joint coupling the two coaxial shafts; and one unilateral reamer having four cutting blades extending from each coaxial shaft, wherein the unilateral reamers are positioned at a predetermined distance from each other and counter to the direction of rotation, the first blade extends a first distance from the drill string, the second blade extends a second distance from the drill string greater than the first distance, the third blade extends a third distance from the drill string greater than the second distance, and the fourth blade extends a fourth distance from the drill string greater than the third distance, wherein none of the blades extends the same distance as any other blade;

wherein the unilateral reamers are diametrically opposed to each other and do not overlap; and wherein the wellbore conditioning system is positionable within the wellbore drill string at a location in or around the bottom hole assembly.

* * * * *